US006206018B1

(12) United States Patent
Daniels, Jr.

(10) Patent No.: US 6,206,018 B1
(45) Date of Patent: Mar. 27, 2001

(54) CRUTCHLESS LEG SUPPORT SYSTEM

(76) Inventor: Thomas S. Daniels, Jr., 1745 Norval St., Pomona, CA (US) 91766-5528

( * ) Notice: Subject to any disclaimer, the term of this patent is extended or adjusted under 35 U.S.C. 154(b) by 0 days.

(21) Appl. No.: 09/368,697

(22) Filed: Aug. 5, 1999

(51) Int. Cl.[7] ..... A61H 3/02
(52) U.S. Cl. ..... 135/69; 602/23
(58) Field of Search ..... 135/68, 69, 65, 135/66; 602/23, 29, 28; 623/28, 29, 31, 32

(56) References Cited

U.S. PATENT DOCUMENTS

| | | | | |
|---|---|---|---|---|
| D. 322,713 | * | 12/1991 | Daniels . | |
| 874,446 | * | 12/1907 | Slater | 602/23 |
| 875,482 | * | 12/1907 | Wyatt | 135/68 |
| 1,383,156 | * | 6/1921 | Sherman | 135/69 |
| 2,172,047 | * | 9/1939 | Jacobucci | 135/69 |
| 2,778,370 | * | 1/1957 | Chamblee | 135/68 |
| 3,985,148 | * | 10/1976 | Cadman | 135/68 |
| 4,141,375 | * | 2/1979 | Tywinski . | |
| 4,274,430 | * | 6/1981 | Schaaf et al. | 135/65 |
| 4,793,370 | * | 12/1988 | Perez et al. . | |
| 4,865,065 | * | 9/1989 | Chen . | |
| 4,884,587 | * | 12/1989 | Mungons . | |
| 5,230,700 | * | 7/1993 | Humbert et al. | 135/65 |
| 5,348,035 | * | 9/1994 | Porter . | |
| 5,605,170 | * | 2/1997 | Wang | 135/68 |

* cited by examiner

*Primary Examiner*—Peter M. Cuomo
*Assistant Examiner*—Jerry Anderson

(57) ABSTRACT

A crutchless leg support system for providing an adjustable, lightweight, and efficient prosthetic device that supports a leg while leaving the user's arms free for use. The crutchless leg support system includes a cushioned arcuate member formed to fit between a user's legs, an adjustable support assembly secured at one end to the cushioned arcuate member, a foot support plate removably secured to the lower portion of the adjustable support means, and a waist securing strap secured to the upper portion of the adjustable support means.

4 Claims, 5 Drawing Sheets

CRUTCHLESS LEG SUPPORT SYSTEM

BACKGROUND OF THE INVENTION

1. Field of the Invention

The present invention relates to crutches and more particularly pertains to a new crutchless leg support system for providing an adjustable, lightweight, and efficient prosthetic device that supports a leg while leaving the user's arms free for use.

2. Description of the Prior Art

The use of crutches is known in the prior art. More specifically, crutches heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,141,375; U.S. Pat. No. 5,348,035; U.S. Pat. No. 322,713; U.S. Pat. No. 4,884,587; U.S. Pat. No. 4,793,370; and U.S. Pat. No. 4,865,065.

While these devices fulfill their respective, particular objectives and requirements, the aforementioned patents do not disclose a new crutchless leg support system. The inventive device includes a cushioned arcuate member formed to fit between a user's legs, an adjustable support assembly secured at one end to the cushioned arcuate member, a foot support plate removably secured to the lower portion of the adjustable support means, and a waist securing strap secured to the upper portion of the adjustable support means.

In these respects, the crutchless leg support system according to the present invention substantially departs from the conventional concepts and designs of the prior art, and in so doing provides an apparatus primarily developed for the purpose of providing an adjustable, lightweight, and efficient prosthetic device that supports a leg while leaving the user's arms free for use.

SUMMARY OF THE INVENTION

In view of the foregoing disadvantages inherent in the known types of crutches now present in the prior art, the present invention provides a new crutchless leg support system construction wherein the same can be utilized for providing an adjustable, lightweight, and efficient prosthetic device that supports a leg while leaving the user's arms free for use.

The general purpose of the present invention, which will be described subsequently in greater detail, is to provide a new crutchless leg support system apparatus and method which has many of the advantages of the crutches mentioned heretofore and many novel features that result in a new crutchless leg support system which is not anticipated, rendered obvious, suggested, or even implied by any of the prior art crutches, either alone or in any combination thereof.

To attain this, the present invention generally comprises a cushioned arcuate member formed to fit between a user's legs, an adjustable support assembly secured at one end to the cushioned arcuate member, a foot support plate removably secured to the lower portion of the adjustable support means, and a waist securing strap secured to the upper portion of the adjustable support means.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new crutchless leg support system apparatus and method which has many of the advantages of the crutches mentioned heretofore and many novel features that result in a new crutchless leg support system which is not anticipated, rendered obvious, suggested, or even implied by any of the prior art crutches, either alone or in any combination thereof.

It is another object of the present invention to provide a new crutchless leg support system that may be easily and efficiently manufactured and marketed.

It is a further object of the present invention to provide a new crutchless leg support system that is of a durable and reliable construction.

An even further object of the present invention is to provide a new crutchless leg support system which is susceptible of a low cost of manufacture with regard to both materials and labor, and which accordingly is then susceptible of low prices of sale to the consuming public, thereby making such crutchless leg support system economically available to the buying public.

Still yet another object of the present invention is to provide a new crutchless leg support system which provides in the apparatuses and methods of the prior art some of the advantages thereof, while simultaneously overcoming some of the disadvantages normally associated therewith.

Still another object of the present invention is to provide a new crutchless leg support system for providing an adjustable, lightweight, and efficient prosthetic device that supports a leg while leaving the user's arms free for use.

Yet another object of the present invention is to provide a new crutchless leg support system which includes a cushioned arcuate member formed to fit between a user's legs, an adjustable support assembly secured at one end to the cushioned arcuate member, a foot support plate removably secured to the lower portion of the adjustable support means, and a waist securing strap secured to the upper portion of the adjustable support means.

Still yet another object of the present invention is to provide a new crutchless leg support system that leaves a user's hands free during walking using the present invention.

Even still another object of the present invention is to provide a new crutchless leg support system that is highly efficient compared to current prosthetic devices.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
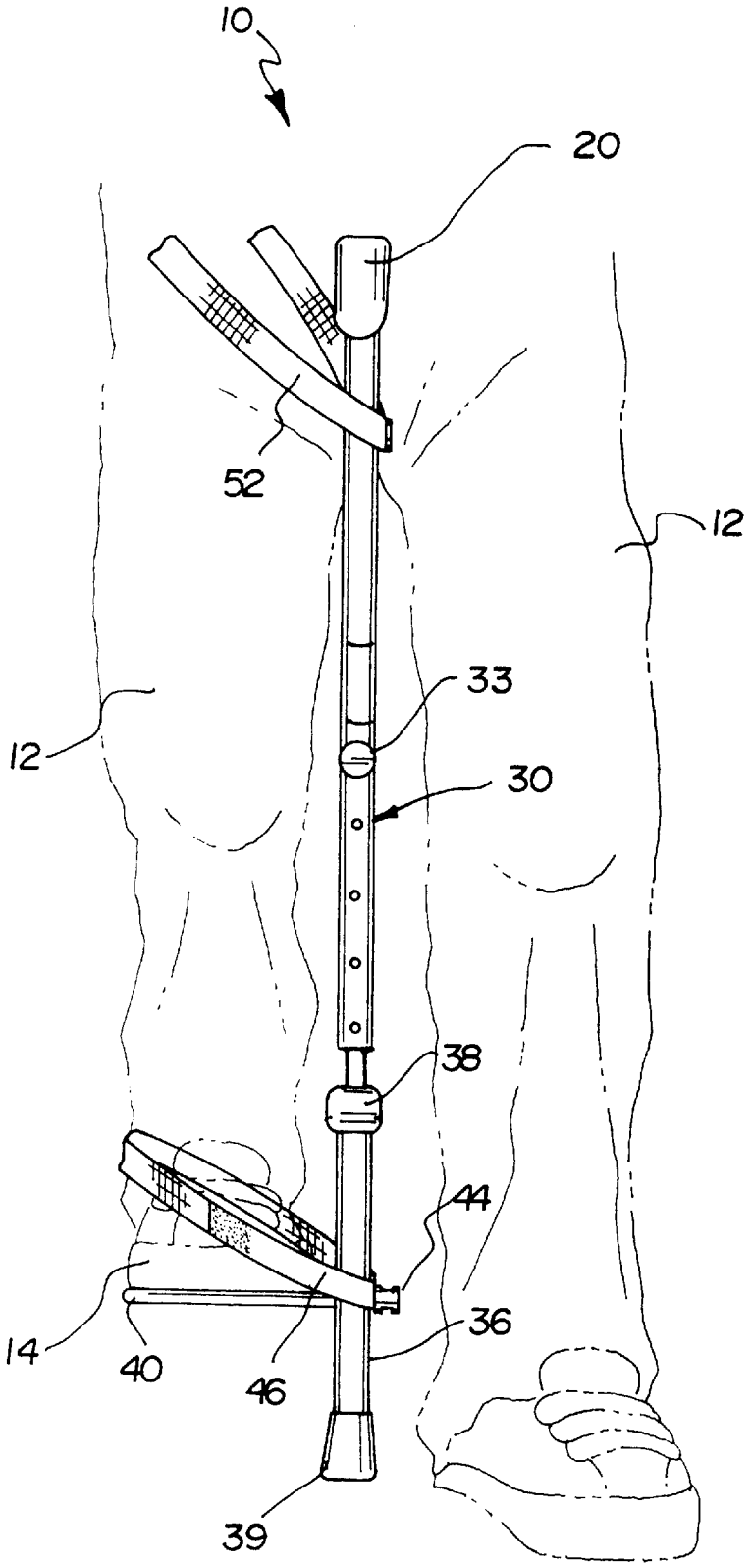
FIG. 1 is a side view of a new crutchless leg support system engaging between a user's legs according to the present invention.

With reference now to the drawings, and in particular to FIGS. 1 through 6 thereof, a new crutchless leg support system embodying the principles and concepts of the present invention and generally designated by the reference numeral 10 will be described.

As best illustrated in FIGS. 1 through 6, the crutchless leg support system 10 generally comprises a cushioned arcuate member 20 formed to comfortably fit within the crotch area of the user, an adjustable support means 30 secured to the bottom surface of the cushioned arcuate member 20 projecting vertically downward, a foot support plate 40 secured orthogonally to the lower portion of the adjustable support means 30, and a waist securing strap 50 secured to the upper portion of the adjustable support means 30.

Figure 2:
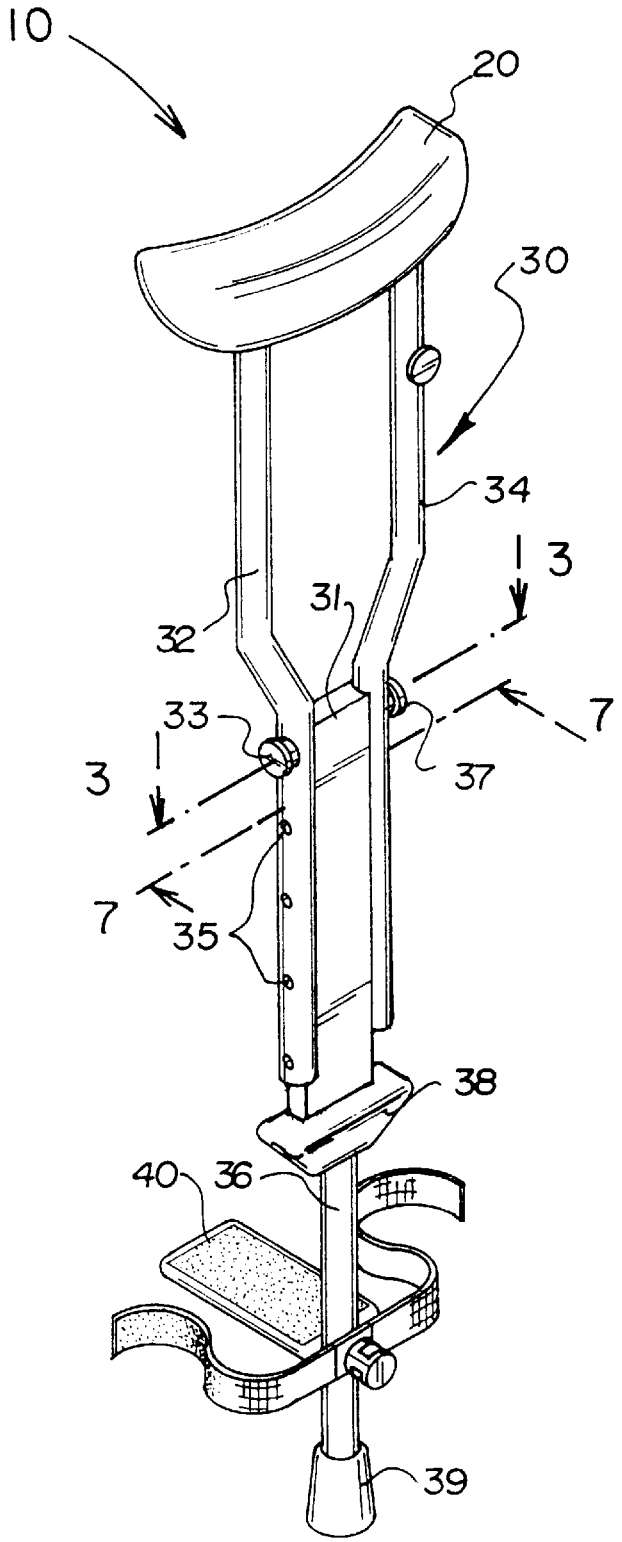
FIG. 2 is an upper side perspective view of the present invention disclosing the adjustable support means in relation to the cushioned arcuate member and the foot support plate.
Figure 3:
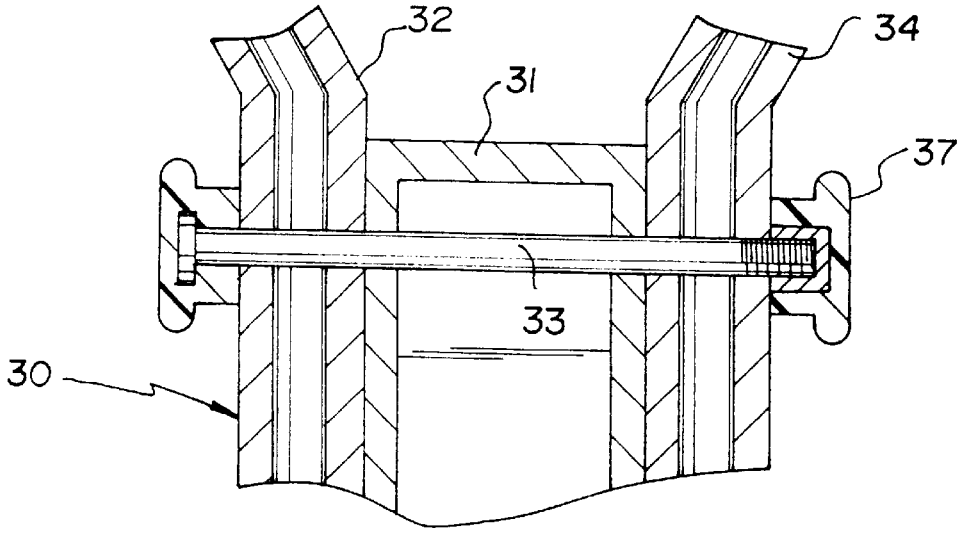
FIG. 3 is a cross sectional view taken along line 3—3 of FIG. 2 disclosing the central support member juxtaposed to the first and second support tubes.
Figure 4:
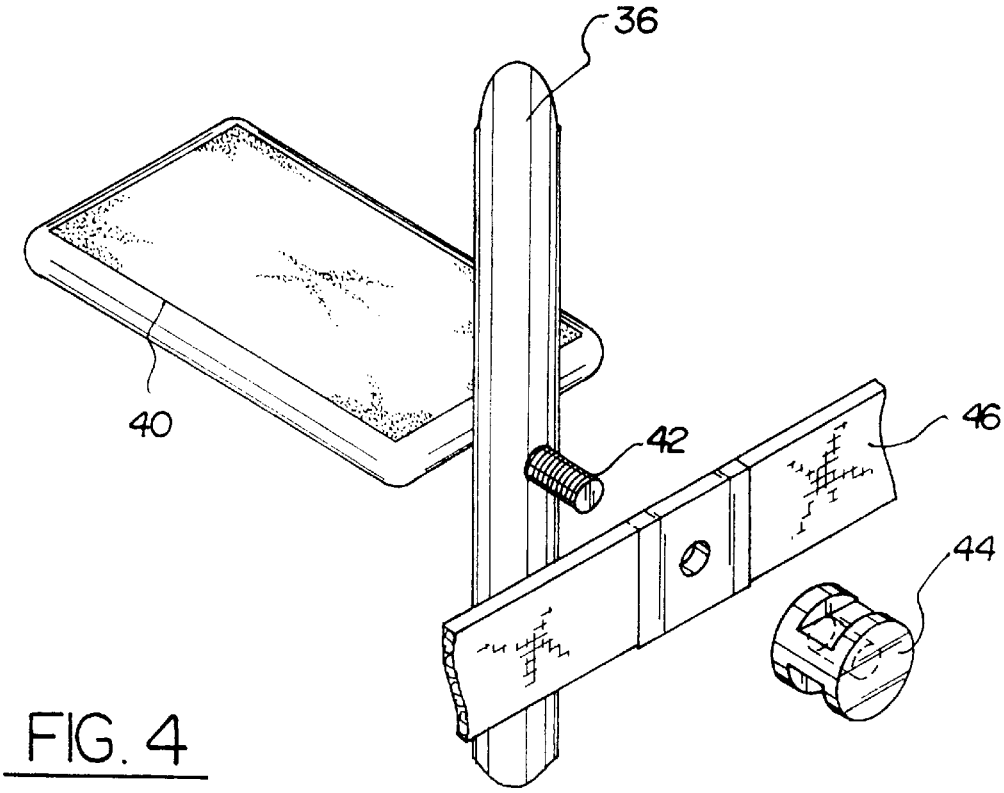
FIG. 4 is a magnified view of the foot support plate.
Figure 5:
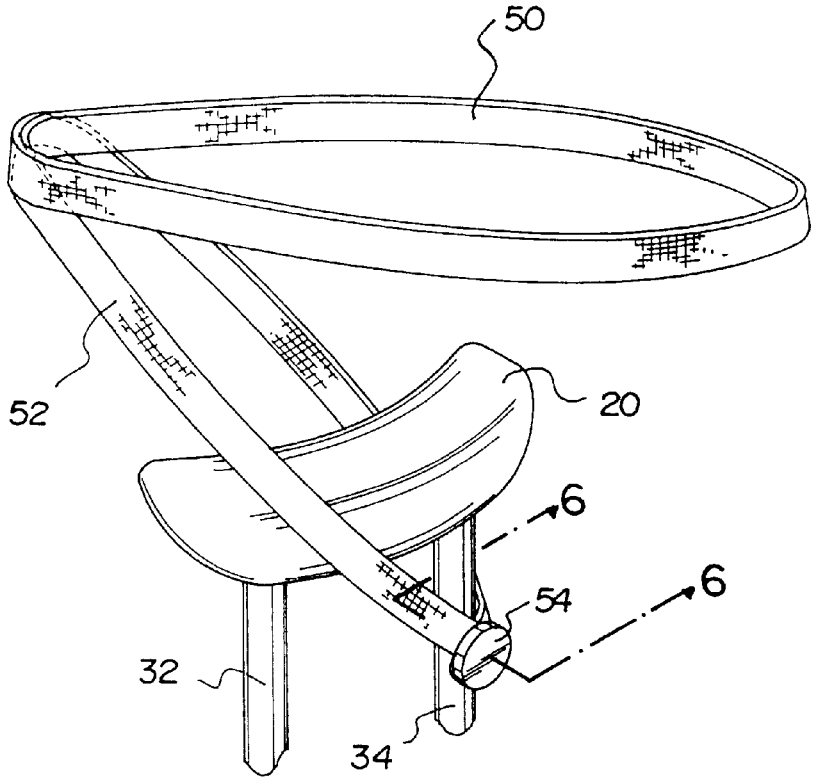
FIG. 5 is a magnified view of the waist securing strap.
Figure 6:
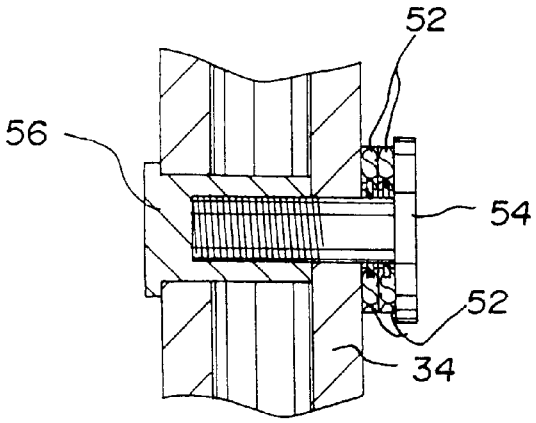
FIG. 6 is a cross sectional view taken along line 6—6 of FIG. 5 disclosing the threaded fastener mating with the threaded metal sleeve opposite of the second support tube.
Figure 7:
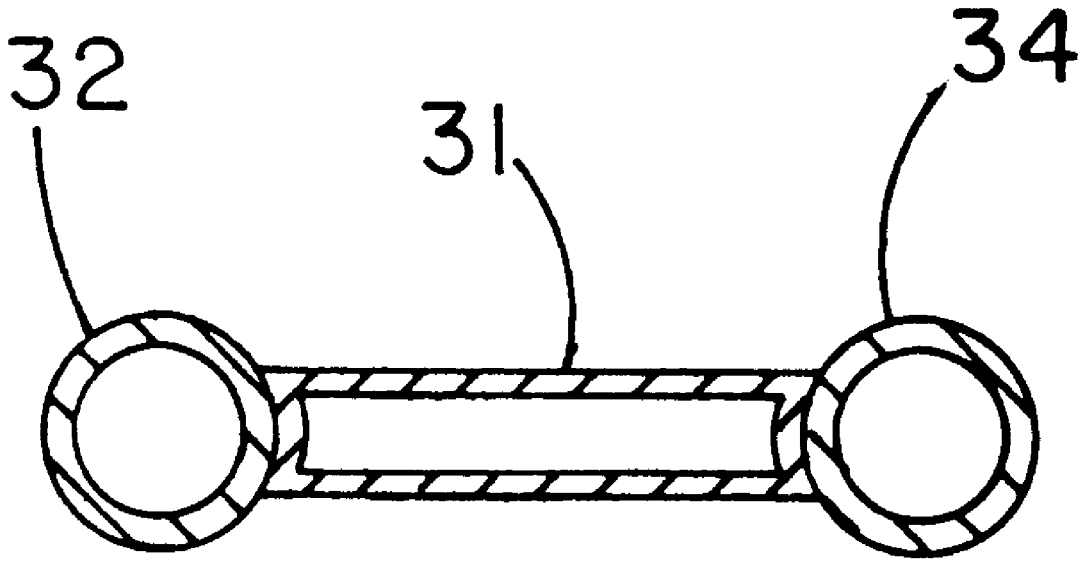
FIG. 7 is a cross sectional view taken along line 7—7 of FIG. 2 disclosing the structure of the central support member.

As best illustrated in FIGS. 1 through 6, it can be shown that the adjustable support means 30 includes a first support tube 32 secured at one end to the cushioned arcuate member 20 including a plurality of adjusting apertures 35. A second support tube 34 is secured at one end to the cushioned arcuate member 20 substantially parallel to the first support tube 32 and including a plurality of adjusting apertures 35 corresponding the first support tube 32's plurality of adjusting apertures 35 as best shown in FIG. 2 of the drawings. A central support member 31 is slidably positioned between the first support tube 32 and the second support tube 34, and includes a plurality of adjusting apertures 35 corresponding to the first and second support tube's adjusting apertures 35. An adjusting pin 33 projects through the adjusting apertures 35 of the first support tube 32 then through the central support member 31 and then through the second support tube 34 coupling to a threaded adjusting cap 37 as best shown in FIG. 3 of the drawings. A flat plate 38 is secured to the bottom end of the central support member 31. A support leg 36 is secured at one end to the bottom of the flat plate 38 projecting along the longitudinal axis of the adjustable support means 30. A rubber base 39 is secured to the end of the support leg 36 opposite of the flat plate 38. The foot support plate 40 includes a threaded pin 42 projecting through the support leg 36 and further projecting through a foot strap 46 and coupling to a threaded support cap 44 as best shown in FIG. 4 of the drawings. The waist securing strap 50 is preferably adjustable to the waist size of the user, where a connecting strap 52 is secured at one end to the waist securing strap 50 and secured to the second support tube 34 by a threaded fastener 54 projecting through said connecting strap 52 coupling with a threaded metal sleeve 56 on the opposite side of the second support tube 34. The adjustable support means 30 is preferably constructed from a light weight material such as aluminum.

In use, user inserts the cushioned arcuate member 20 between his legs within the crotch region. The user then secures the waist securing strap 50 around his waist and connects the connecting strap 52 to the upper portion of the second support tube 34. The user then secures the foot strap 46 around his foot 14 thereby retaining the longitudinal axis of the present invention in line with the longitudinal axis of the injured leg 12. The user then is able to walk while distributing substantially all of his weight to the cushioned arcuate member 20 while walking on the injured leg 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A crutchless leg support system comprising:

a cushioned arcuate member adapted for comfortably fitting in a crotch area of a user;

an adjustable support assembly secured to the bottom surface of the cushioned arcuate member, the support assembly projecting vertically downward;

a foot support plate secured orthogonally to a lower portion of the adjustable support means; and a waist securing strap secured to an upper portion of the adjustable support means;

a first support tube secured at one end to the cushioned arcuate member, the first support tube including a plurality of adjusting apertures;

a second support tube secured at one end to the cushioned arcuate member, the second support tube being positioned substantially parallel to the first support tube, the second support tube including a plurality of adjusting apertures corresponding to the first support tube's plurality of adjusting apertures;

a central support member slidably positioned between the first support tube and the second support tube, the central support member including a plurality of adjusting apertures corresponding to the first and second support tube's adjusting apertures, the central support member having a pair of sides each having an annular recess for engaging one of the first and second support tubes such that each annular recess is for preventing rotation of the first and second support tube in respect to the central support member;

an adjusting pin projecting through the adjusting apertures of the first support tube, the adjusting pin projecting through the central support member and through the second support tube, the adjusting pin being couplable to a threaded adjusting cap;

a flat plate secured to a bottom end of the central support member;

a support leg secured at one end to a bottom of the flat plate projecting along a longitudinal axis of the adjustable support assembly; and a rubber base secured to the end of the support leg opposite of the flat plate.

2. The crutchless leg support system of claim 1, wherein the foot support plate includes a threaded pin projecting through the support leg, through a foot strap and coupling to a threaded support cap.

3. The crutchless leg support system of claim 2, wherein the waist securing strap is adjustable to a waist size of the user, wherein a connecting strap is secured at one end to the waist securing strap, the connecting strap being secured to the second support tube by a threaded fastener projecting through said connecting strap, said threaded fastener being coupled to a threaded metal sleeve on an opposite side of the second support tube.

4. The crutchless leg support system of claim 3, wherein the adjustable support assembly is constructed from a light weight material such as aluminum.

* * * * *